US005950373A

United States Patent [19]

von Hoff et al.

[11] Patent Number: 5,950,373

[45] **Date of Patent: *Sep. 14, 1999**

[54] TRANSPORTABLE STRUCTURE KIT

[75] Inventors: Christiane von Hoff, Alpharetta, Ga.; John C. Dingemanse, Legana, Australia

[73] Assignee: Oakwood Homes Corporation, Greensboro, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/823,885

[22] Filed: Mar. 17, 1997

[30] Foreign Application Priority Data

Oct. 4, 1996 [AU] Australia ..... PO2746

[51] Int. Cl.[6] ..... E04H 1/00; E04B 1/343

[52] U.S. Cl. ..... 52/79.5; 52/64; 52/143; 206/321; 220/1.5

[58] Field of Search ..... 52/79.5, 143, 64, 52/34; 220/1.5, 4.33, 4.26, 4.2; 206/321

[56] References Cited

U.S. PATENT DOCUMENTS

| | | | |
|---|---|---|---|
| 3,387,733 | 6/1968 | Field . | |
| 4,327,529 | 5/1982 | Bigelow et al. | 52/34 |
| 4,637,179 | 1/1987 | Bigelow et al. | 52/79.5 |
| 4,700,513 | 10/1987 | Smith | 52/143 X |
| 4,788,802 | 12/1988 | Wokas | 52/34 X |
| 4,858,779 | 8/1989 | Zimmerlund | 220/1.5 X |
| 4,891,919 | 1/1990 | Palibrod | 52/79.5 |
| 5,069,143 | 12/1991 | Bunger | 52/143 X |
| 5,237,784 | 8/1993 | Ros | 52/79.5 |
| 5,279,436 | 1/1994 | Elliot et al. | 52/143 X |
| 5,447,000 | 9/1995 | Larsen | 52/79.5 X |
| 5,491,934 | 2/1996 | Bigelow et al. | 52/143 X |
| 5,596,844 | 1/1997 | Kalinowski | 52/79.5 |

FOREIGN PATENT DOCUMENTS

| | | | |
|---|---|---|---|
| 2075083 | 11/1981 | United Kingdom | 52/79.5 |

*Primary Examiner*—Robert Canfield
*Attorney, Agent, or Firm*—Hunton & Williams

[57] ABSTRACT

A transportable structure kit which is readily transportable within a container. The container has exterior container panel sections adapted to attach together to form a completely enclosed transportable container. A number of interior panel sections are placed within the enclosed transportable container. Lugs are placed on corners of the completely enclosed transportable container to allow the container to be lifted and moved. The exterior container panel sections detachably attached together to form the enclosed transportable container in a transportation mode. The exterior panel sections not used to form the floor, namely are used to form a second story floor of the assembled structure. The transportable structure kit further includes telescoping footing sections to permanently yet adjustable adjust the height of the floor relative to a foundation.

16 Claims, 8 Drawing Sheets

TRANSPORTABLE STRUCTURE KIT

BACKGROUND OF THE INVENTION

1. Field of the Invention

The present invention relates to a transportable structure kit of the type which includes a plurality of pre-formed elements. The invention has particular application for transportable structures which are used as modular or kit homes and the invention is hereinafter described in that context. However, it is to be appreciated that the invention has broader application and is not limited to this particular use.

1. State of the Prior Art

Modular or kit homes are well known and typically comprise pre-formed elements which are fabricated off site and transported in a disassembled condition. Once on site, the pre-formed elements are assembled to form the main structure of the house. The modular home has various advantages as compared to traditional on site housing construction methods including the reduced cost of manufacture, and the relative ease of assembly. A further advantage is that as the pre-formed elements are manufactured off site, the fabricated elements can be manufactured in a more controlled environment thereby enabling better control over the quality of the components of the house. With these advantages, the modular home is ideally suited for low cost housing or for use in remote locations.

In recent times there has been an increase in demand for low cost housing, particularly in developing countries. The use of modular homes has been seen as a solution to this demand, not only because of the cheaper manufacturing cost, but because simplified assembly enables local semi-skilled labour force to be used. However, due to the magnitude of the demand for housing and the limited resources available in developing countries, there is a continuing need to minimise the costs of the modular housing to enable it to be viable. Furthermore, logistic problems such as transporting and assembly present further problems in the acceptance of this type of housing as a solution to this demand.

Others have attempted to provide readily transportable modular structures. U.S. Pat. No. 5,403,055 to Allison et al. discloses H-shaped end structures for use in bolting together a plurality of panels. The panels are used in assembling a structure on site. The H-shaped end structures include fittings on their end for use in picking up and moving the bolted together panels. The H-shaped end structures of the Allison et al. design are not used in the final construction of the structure, and are not adapted to allow the bolted together panels to form a completely enclosed container which can be used to contain all parts of the finished structure in clean and completely enclosed container.

U.S. Pat. No. 5,317,857, also to Allison, discloses a completely pre-manufactured structure with vertical telescoping beam structures which are attachable to each comer of the structure to allow the completed structure to be shipped. One major disadvantage of the Allison system is that the size and shape of the resulting completed structure is limited due to shipping size constraints, viz., must not be taller, wider, or longer than standard shipping containers. Another disadvantage is that the units are not easily stackable during shipping since the entire weight of the structure will be carried on the telescoping beam structures, and damage to walls of the structure, if stacked during shipping or transportation, is likely.

U.S. Pat. No. 4,696,132 to LeBlanc discloses a foldable shelter system and method of construction, wherein four side walls are hingeably attached to a continuous floor section, and lay parallel thereto in a shipping mode. Upon assembly, the four walls are swung up to a vertical position and comer beams members are inserted into the corners. The design of the LeBlanc system is not adapted to allow internal components of a complete structures, such as preplumbed bathrooms or kitchens to be enclosed therein, and are more adapted to small shed structures.

U.S. Pat. No. 4,075,814 to Theurer et al. discloses a modular housing system wherein part of the module serves as a shipping container for the remainder of the module. In the Theurer et al. design, completed sections of a house are manufactured at a factory, and are stacked one inside the other to form a container. Outer walls of the container are formed by three completed sections of the house, and additional completed sections of the house are also placed within the outer walls of the container for shipping. On serious disadvantage of the Theurer et al. design is that the completed house sections are extremely heavy, and must be assembled on site with cranes and other heavy equipment. Another disadvantage is that the possible designs are considerable limited by the need for the completed sections to be nestable inside each other.

There accordingly remains a need for a transportable structure which solves these problems, and which is adapted to be assembled on site with relatively moderately skilled workers and without heavy equipment.

BRIEF DESCRIPTION OF THE INVENTION

An aim of the present invention is to ameliorate this problem by providing a structure, such as a modular home, which can be transported in a disassembled condition in an innovative transportable package designed to facilitate transporting and assembly of the structure and to further minimise the overall cost involved.

Accordingly, the present invention provides a transportable structure of the type including a plurality of pre-formed elements adapted to be transported in a disassembled condition and assembled on site to form part of the structure. In its broadest terms, the invention is characterised in that, in its disassembled condition, the pre-formed elements form a container to facilitate transporting of the structure on site.

The pre-formed elements of the structure in accordance with the invention are configured to have the dual purpose of being part of the end structure, as well as being part of a container for transporting of the disassembled structure. With this arrangement, significant benefits can be attained. In particular, substantial cost savings can be made as excess packaging is minimised. Furthermore, production, transporting and assembly of the structure can be simplified. For example, the structure can be arranged to be formed on an "unfolding" of the pre-formed elements from their container configuration. As a consequence the container itself becomes a key reference point in the assembly of the structure. This eliminates the need for complete removal of the pre-formed elements and attendant problems in assembly of the structure. Furthermore, this technique enables parts of the structure to be assembled off site and installed in its permanent position within the container. Once on site, the remaining part of the structure can be constructed around these fully installed components. Such an arrangement can be advantageously used in the construction of modular homes to enable difficult areas such as the bathroom and kitchen to be fully assembled off site.

Preferably, the container formed from pre-formed elements of the structure is adapted to conform to the ISO standard and has the ISO standard dimensions for shipping containers. Furthermore, preferably the pre-formed elements include handling lugs, which facilitate craneage, handling, shipping and transportation of the structure in its disassembled condition.

To provide the strength to meet the requirements of the ISO standard, the pre-formed elements preferably include a steel frame. Furthermore, preferably these pre-formed elements are used as structural members in the structure to thereby utilise their strength characteristics in the finished structure.

Preferably, each of the pre-formed elements is square or rectangular and includes a frame having a wall surface secured thereto. In one preferred form, the frame is formed from a plurality of interconnected steel members, typically hollow steel sections, and the wall is formed from sheet material such as plywood or the like.

Preferably, each of the pre-formed elements are releasably coupled together using fasteners or the like to form the container for transporting. Once on site, the pre-formed elements are uncoupled enabling them to be repositioned in assembly of the structure. In one form the individual pre-formed elements are bolted together and are spot welded to seal the contents therein for transporting. Once on site, the bolts are merely cut off to uncouple the pre-formed elements.

Preferably at least some of the pre-formed elements are adapted to form the floor of the structure. In a preferred form, the structure includes footing members which are engagable with the frame of the pre-formed elements. In one embodiment, the footings are height adjustable to thereby facilitating correct placement of the structure on site. In this arrangement, the footings are installed prior to placement on site of the structure in its disassembled condition.

In one form, the footing includes two parts which are movably relative to each other to provide the height adjustment. In a preferred form, the footings include an outer casing incorporating a passage therein adapted to receive a strut. The outer casing is typically fixed in the ground through a concrete base or the like. A distal end of the strut extends through the outer casing and is adapted to be secured to the frame of the pre-formed element. A fastening arrangement is provided between the outer casing and the strut to secure the two parts of the footing together to prevent relative sliding thereto when the strut is located at its correct height.

In one form, the structure includes two levels and the preformed elements used to form the container are adapted to provide the flooring for both these levels. In one arrangement where the container meets ISO dimensions, the "top" and "bottom" panels of the container are used to provide the upper and lower flooring respectively. These panels are internally supported, preferably by internal partition walls used in the structure, when in the container configuration. In this way, the core of the structure is in its permanent position within the container and once on-site, the "sides" and "ends" of the container can be removed leaving this core in place.

The transportable structure incorporating the pre-formed elements is ideally suited for use in modular homes. The structure in its disassembled condition facilitates transporting as all the elements of the structure are within a single container. Furthermore as the container is formed from elements used in the structure itself, assembly of the structure can be greatly simplified. A modular home with this system may be erected in 2–4 days as compared to 6–10 weeks for a home using traditional on-site construction techniques. Because of the speed of erection and the ease of transportation, the structure can also be used as a mobile home or as a temporary structure. In this arrangement, a purpose built trailer is provided which enables the container to be transported by road thereby enabling the structure to be easily moved as required.

BRIEF DESCRIPTION OF THE DRAWINGS

It will be convenient to hereinafter describe an embodiment of the invention in greater detail with reference to the accompanying drawings. The particularity of these drawings in their related description is not to be understood as superseding the preceding broad description of the invention.

DETAILED DESCRIPTION OF THE INVENTION

Figure 1:
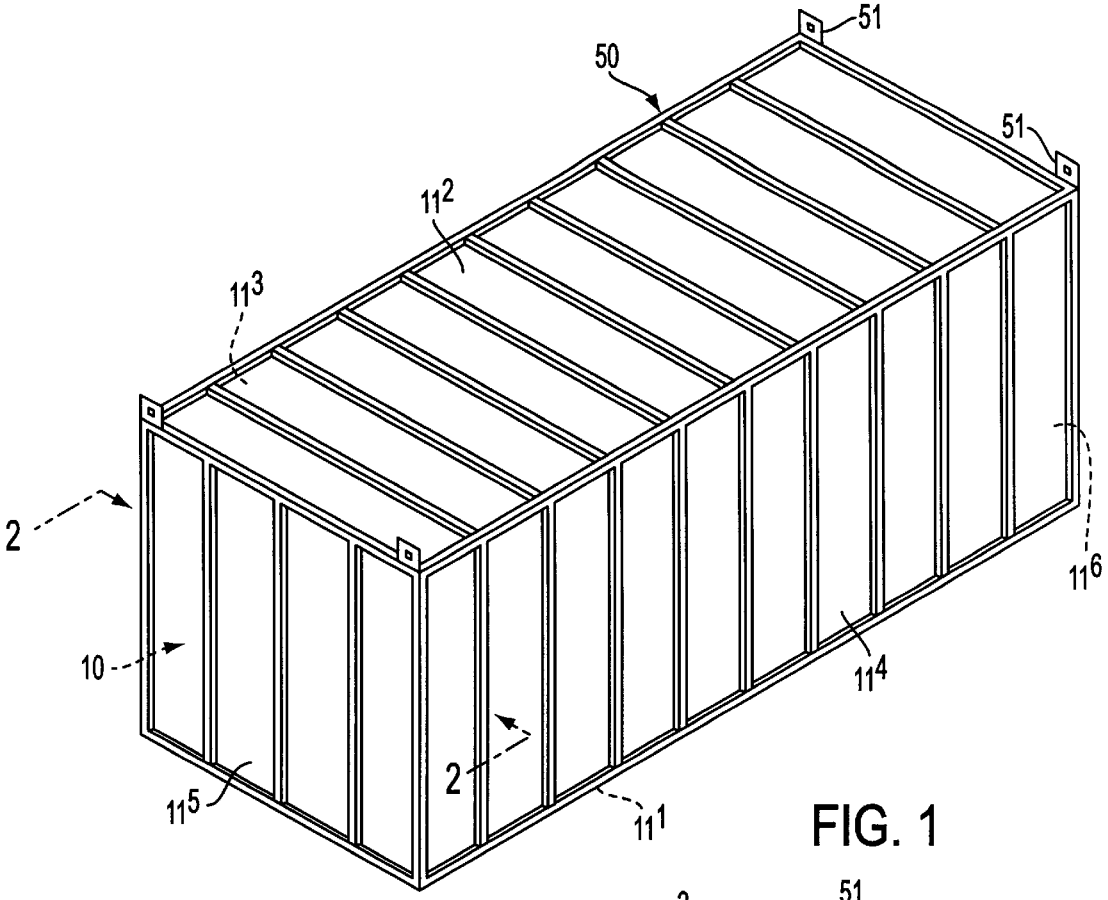
FIG. 1 is a perspective view of a modular structure in a disassembled condition, with pre-formed elements of the structure forming a container for transporting the disassembled structure.
Figure 2:
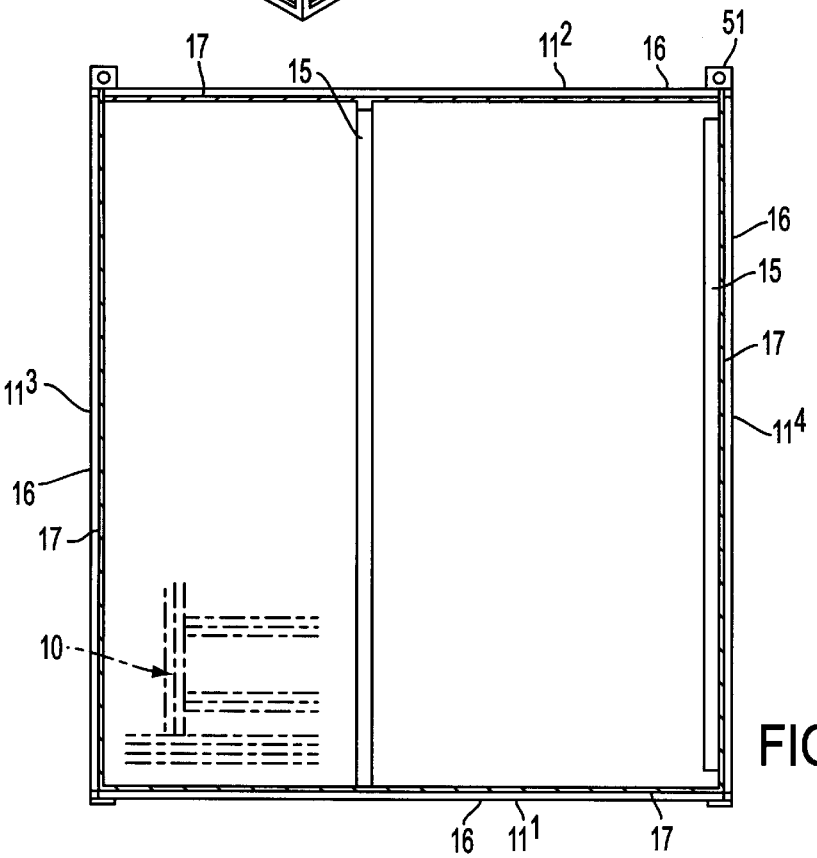
FIG. 2 is a cross sectional view along section lines II—II of FIG. 1.
Figure 3:
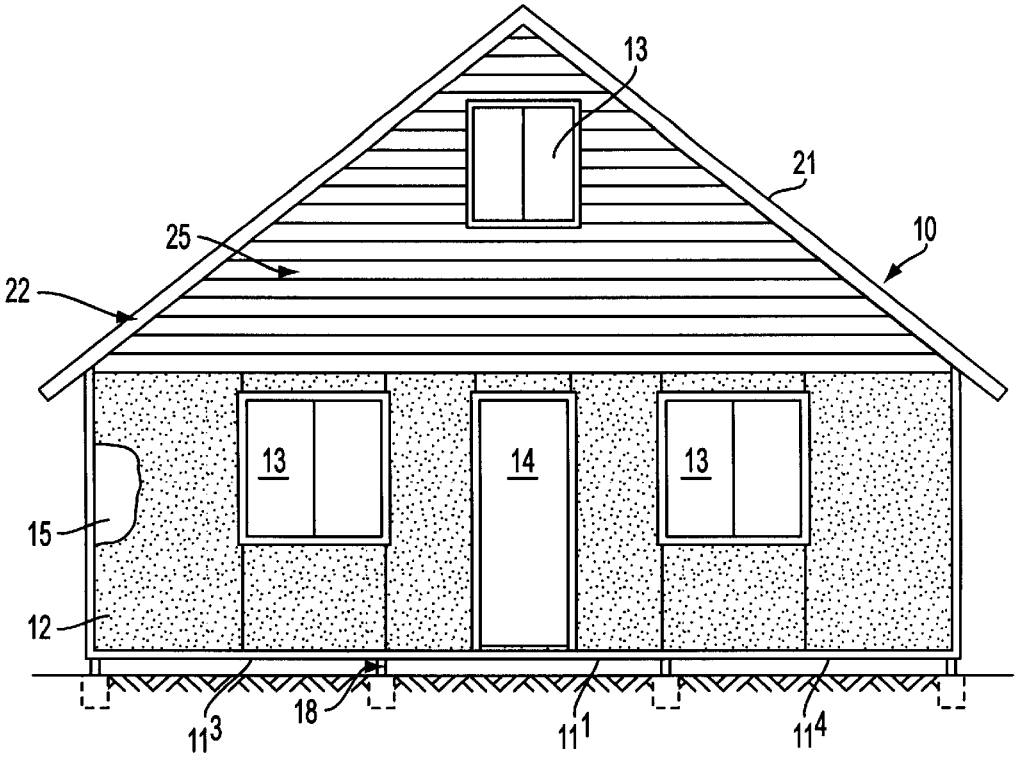
FIG. 3 is a front elevation of the modular structure in its assembled condition.
Figure 4:
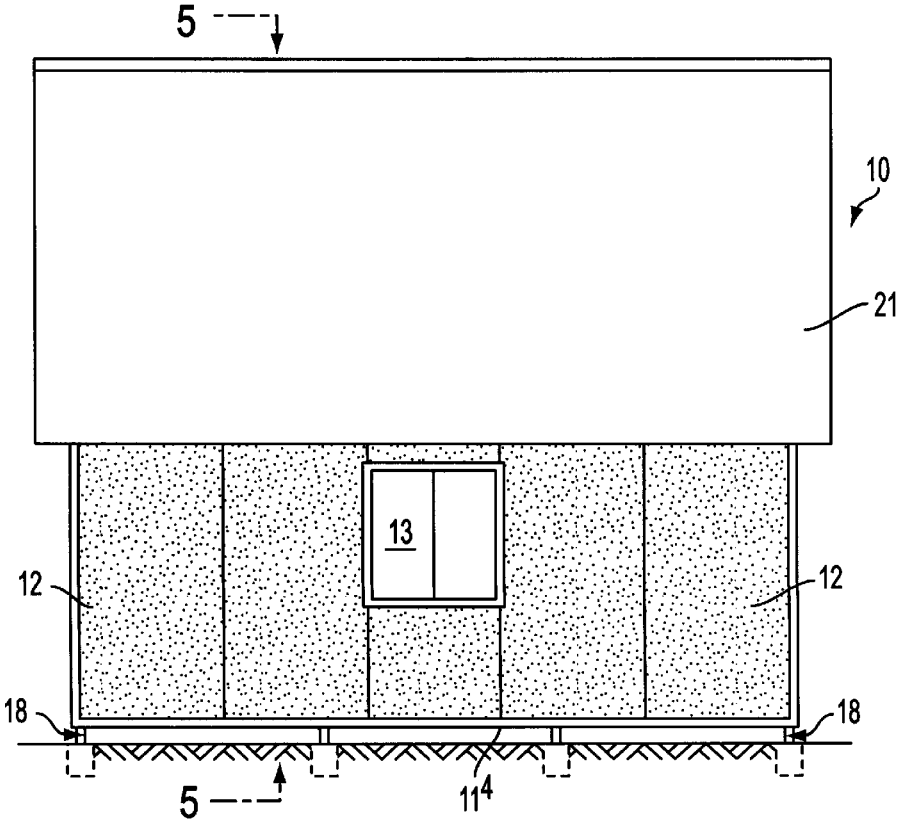
FIG. 4 is a side elevation of the structure of FIG. 3.
Figure 5:
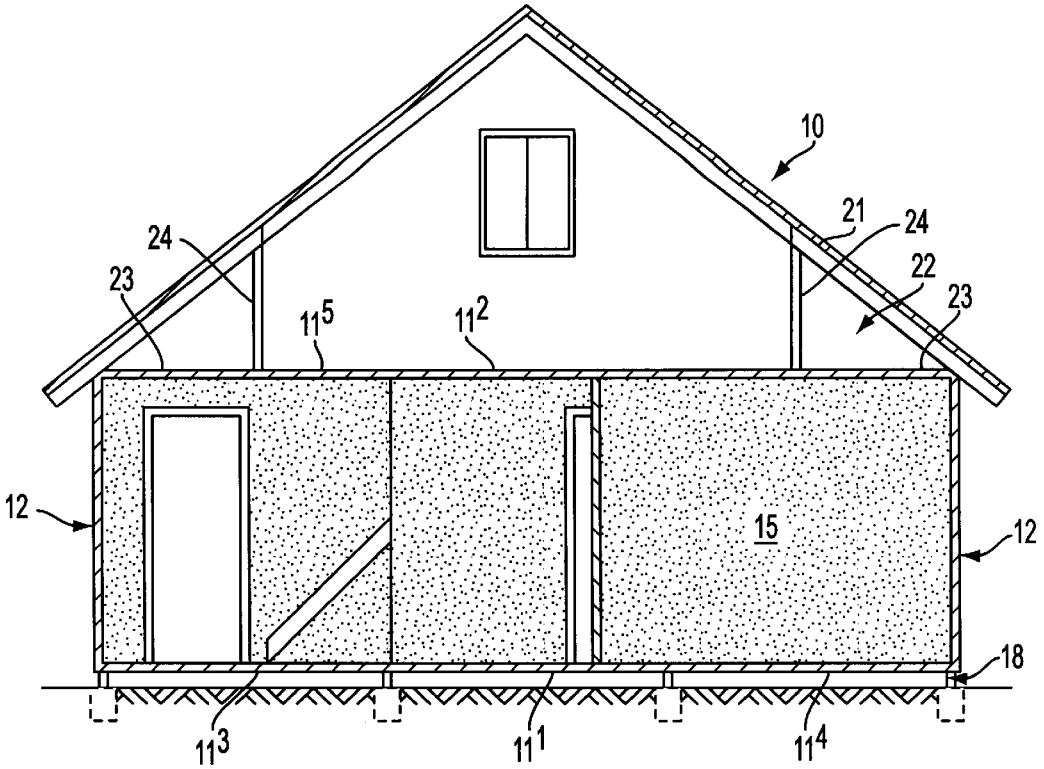
FIG. 5 is a sectional view along section line V—V of FIG. 4.

With references to FIGS. 1–5, a modular structure 10 is disclosed which is formed from a plurality of pre-formed elements. These pre-formed elements include floor frames 11, wall sections 12, windows 13, door 14, and internal partitions 15. The structure 10 is adapted to be transported in a disassembled form as illustrated in FIGS. 1 and 2 and arranged to be assembled to form the house as illustrated in FIGS. 3–5.

In the disassembled condition as illustrated in FIGS. 1 and 2, the floor sections 11 are adapted to be coupled together to form a container 50. In the illustrated arrangement the container 50 conforms to the ISO standard and has ISO standard dimensions for shipping containers. The container further includes handling lugs 51 so that the container 50 can be loaded onto a container ship by means of the standard crane. Because of its overall ISO standard dimensioning, the container is readily lifted into the ship's racking system.

To meet the requirements of the ISO standard, and to ensure the container 50 provides adequate protection for the components of the structure during transportation, the floor sections 11 include a steel frame 16. In the illustrated form, the frame 16 of each section is formed from a series of interconnected square hollow section members and the flooring is formed from sheet material 17 secured to the frame. In the arrangement shown, the steel members are welded together and the sheet material, which is typically in the form of structural plywood, is fixed to the frame 16 by fasteners such as bolts or rivets. The floor sections are fastened together using bolts or the like to form the container 50 and once assembled, the frame 16 of the floor sections 11 effectively forms a cage around the exterior of the container.

The container 50 is adapted to store the remaining component parts for the structure 10 so that the structure, in its disassembled condition, is easily transportable. Moreover in the illustrated form, certain parts of the structure 10 are located within the container in their final fully installed position. In particular, internal partition walls 15 are located in a upright configuration within the container 50 and interconnect the bottom floor section $\mathbf{11}^1$ with the top floor section $\mathbf{11}^2$. In this position the partition walls 15 are load bearing and designed to support the top floor section $\mathbf{11}^2$ on removal of the container sides $\mathbf{11}^3$ and $\mathbf{11}^4$ and container ends $\mathbf{11}^5$ and $\mathbf{11}^6$.

Moreover, whilst not shown, the bathroom walls, fixtures and joinery are installed and connected in their permanent position on floor section $\mathbf{11}^1$. This ensures that the labour intensive and technically difficult wet area work is installed and plumbed off site. Furthermore, the kitchen cupboards may also be permanently installed together with associated wall linings and finishes. The electric wiring as well as plumbing and drainage is installed ready to accept a simple connection once on site.

While the illustrated embodiment discloses the container formed solely from floor sections, it is to be appreciated that the container 50 may be made up of other pre formed elements of the structure such as wall or roof sections or the like.

Figure 7:
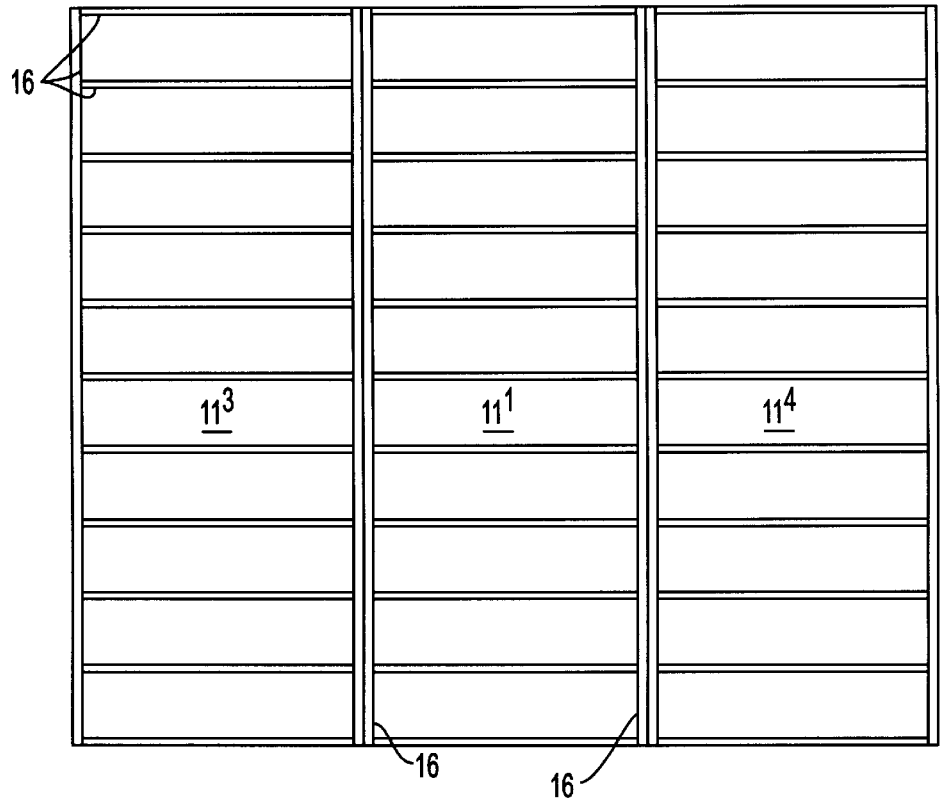
FIG. 7 is a floor plan of the modular structure illustrating the pre-formed elements formed as the floor of the structure.
Figure 10:
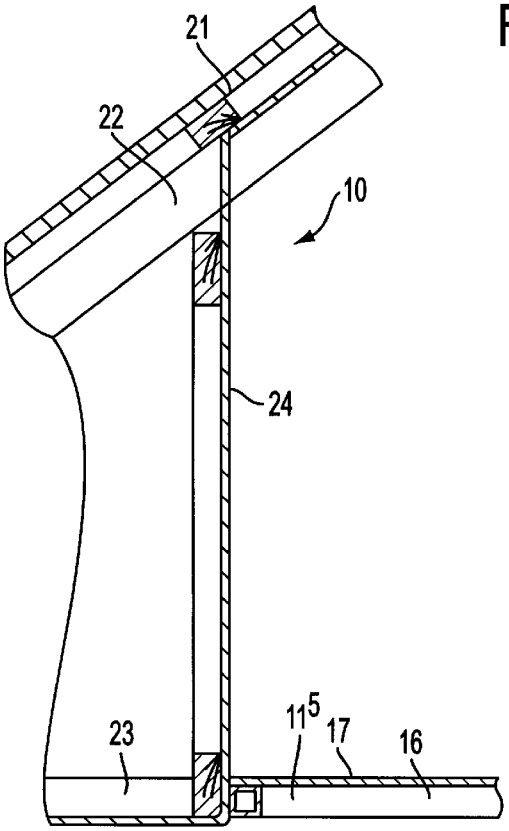
FIGS. 10 and 10*a* are detailed views of the floor, and ceiling of level two of the modular structure.
Figure 10A:
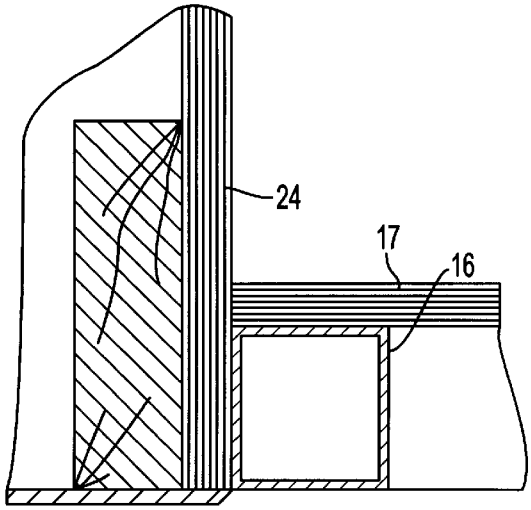
Figure 8:
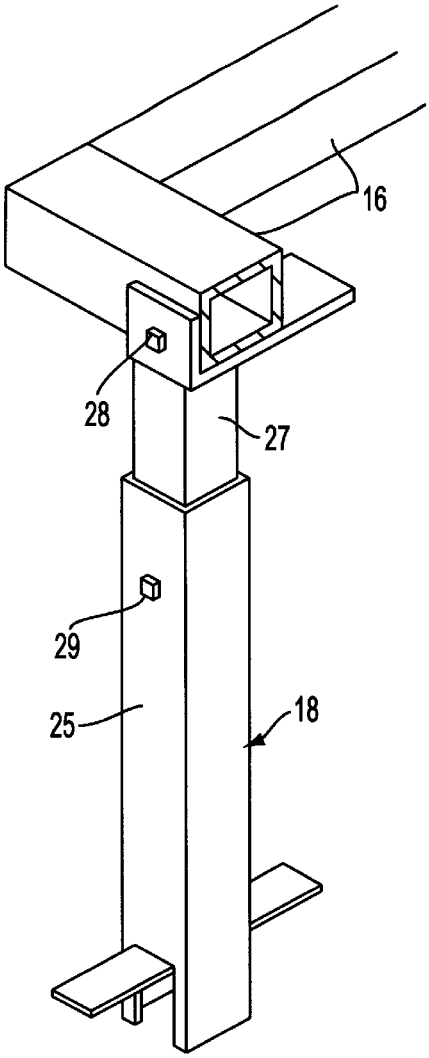
FIG. 8 is a detailed perspective view of the foundation member of the modular structure.
Figure 9:
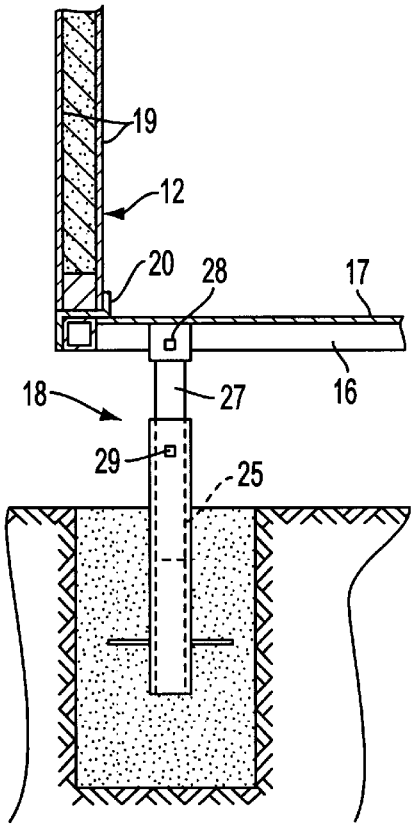
FIGS. 9 and 9*a* are detailed views of the footing, floor and wall of the modular structure.

With reference to FIGS. 3–11, the modular structure 10 in its assembled form comprises a two level house having a ground floor and attic. The floor of the house 10 on the lower level is formed by floor sections $\mathbf{11}^1$, $\mathbf{11}^3$, and $\mathbf{11}^4$, and are supported by footings 18 which will be discussed in more detail below. The floor on the first level is formed from floor section $\mathbf{11}^2$, disposed directly above the floor section $\mathbf{11}^1$, and supported by partition walls 15. The floor on the upper level also includes floor sections $\mathbf{11}^5$, and $\mathbf{11}^6$. Each section is in two parts (not shown) which are secured end to end along one side of the top floor section $\mathbf{11}^2$. In the illustrated form, the end sections are bolted into position and the structural plywood 17 forms the floor as best illustrated in FIGS. 9 and 10.

Figure 9A:
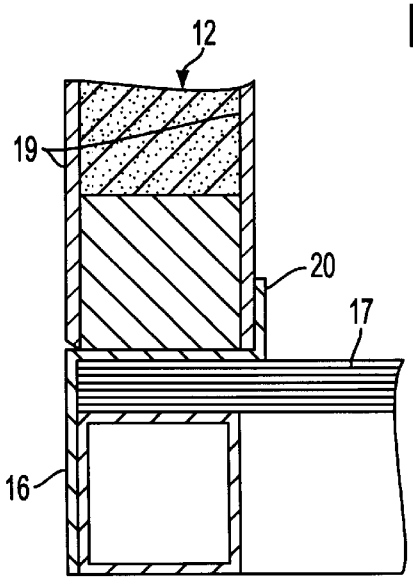

The exterior of the house 10, includes exterior wall sections 12, which in the illustrated form are of a sandwich construction incorporating cement sheets 19. As illustrated in FIGS. 9 and 9*a*, the exterior walls are secured to the wall panels by Z support flashing 20. The roof structure incorporates roof sheeting 21 supported on pre-cut roof components 22. Ceiling floor joists 23 interconnect the external wall 12 to the attic floor. The attic walls 24 are fixed to the attic floor $\mathbf{11}^5$ and $\mathbf{11}^6$ and extend to the roof framing 22 to form a structural box frame for the roof structure. The gable end framing includes weatherboard cladding 25 as illustrated in FIG. 3.

Figure 6:
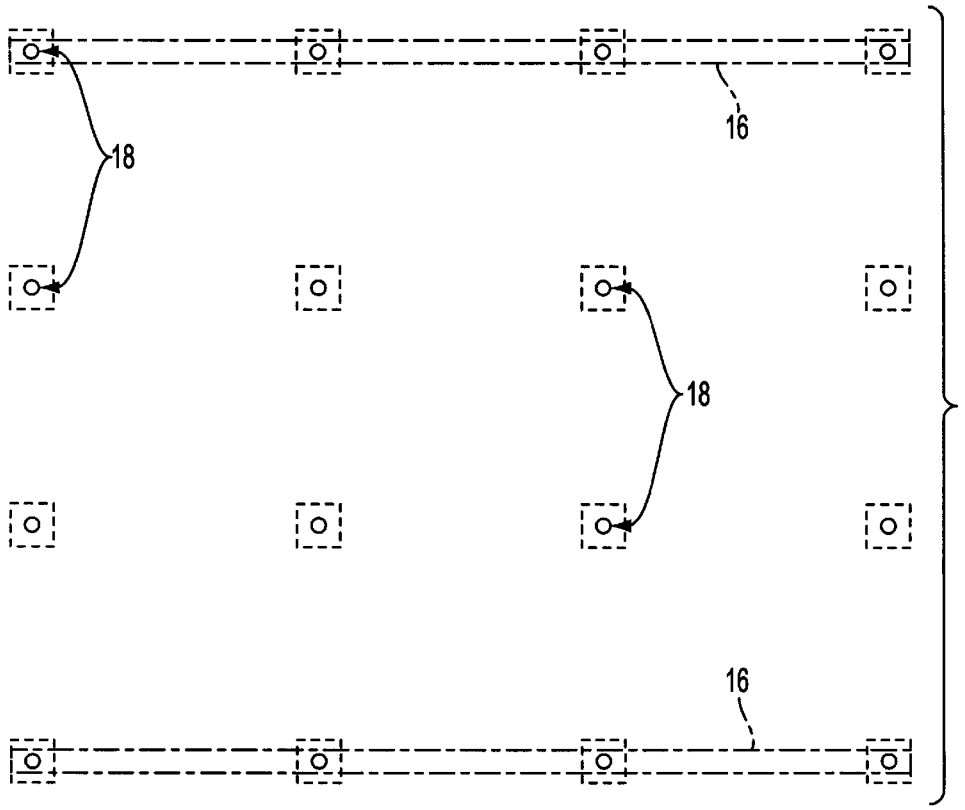
FIG. 6 is a foundation plan for the modular structure.

FIGS. 6–8 show detailed views of the foundation for the modular home 10. The foundations include spaced footings 18 as illustrated in FIG. 6 which are adapted to be located along the edges of respective floor framing sections $\mathbf{11}^1$, $\mathbf{11}^3$, and $\mathbf{11}^4$ as illustrated in FIG. 7. A detailed view of this footing is disclosed in FIGS. 8 and 9. As can be seen, the footing 18 includes an outer casing 25 which is adapted to be fixed in a reinforced concrete base 26 as illustrated in FIG. 9. A floor strut 27, which is typically formed from a square hollow section, is telescopically slidable within the outer casing 25 and includes a bolted connection 28 at its upper end which is adapted to be secured to the frame 16 of the floor sections 11. Once coupled to the floor section, the two parts of the footing 18 are adapted to be secured together by fastener 29.

FIGS. 11–16 are schematic views illustrating various construction steps of the house 10 from its disassembled condition illustrated in FIGS. 1 and 2 to the assembled structure as illustrated in FIGS. 3–5.

Initially, in an offsite location such as a factory, the steel framed plywood floor sections 11 used to make up the container are fabricated. The bathroom walls, fixtures and joinery are installed on the floor section 11 and connected in their permanent position. Kitchen cupboards are also permanently installed, together with associated wall linings and finishes. The electrical wiring as well as plumbing and drainage is installed ready to accept a simple connection on site. All other building components are then packed in the container 50 which is sealed, locked and ready for transport.

The container is then transported either by shipping or by road or rail to its destination and transported by carrier to the building site. The building site is pre-prepared with all services installed below ground with connections in appropriate locations to accept the connections of the modular structure. The container 50 is unloaded from the carrier, preferably in its final position, and is unsealed ready for unpacking and dismantling.

Figure 11:
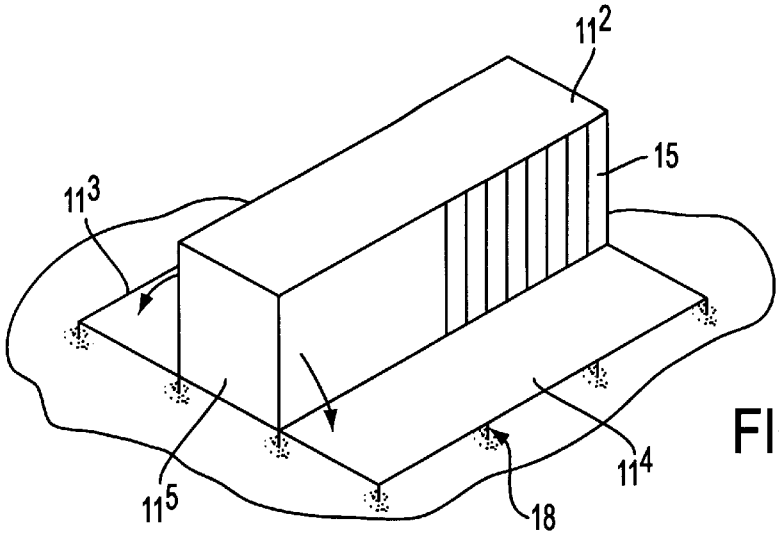
FIGS. 11–16 are schematic views illustrating various steps in the construction of the modular structure.
Figure 12:
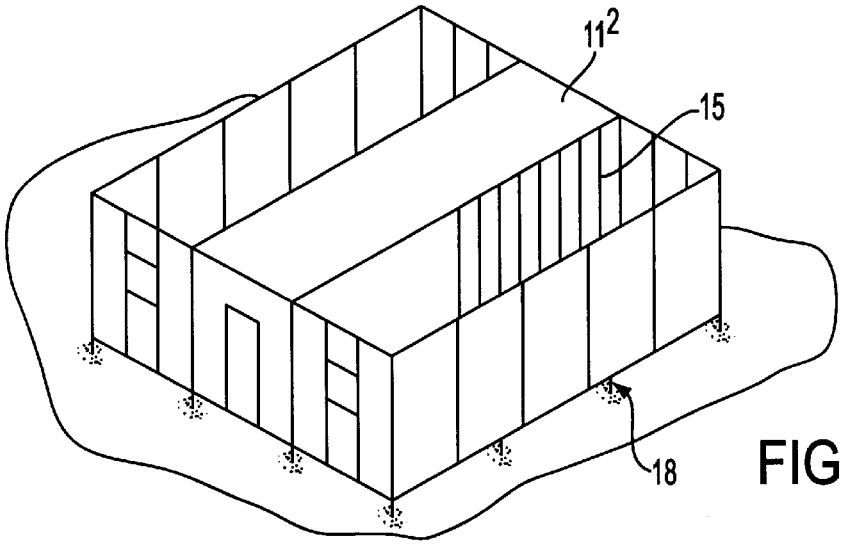

As illustrated in FIG. 11 the container's two sides are folded out and down on the prepared foundations and connected to the specially designed footings 18. The pre manufactured insulated external wall panels are then erected and fixed to the floor platform by means of the steel Z support flashing as illustrated in FIG. 12.

Figure 13:
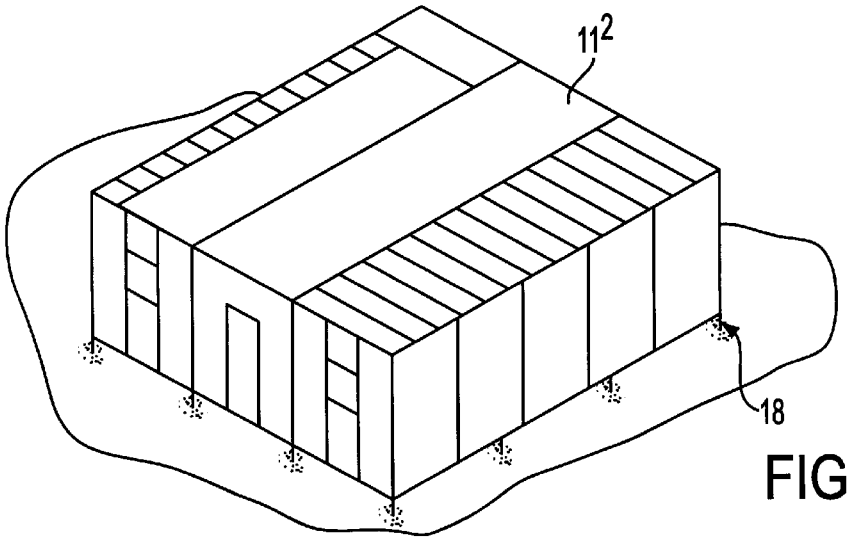
Figure 14:
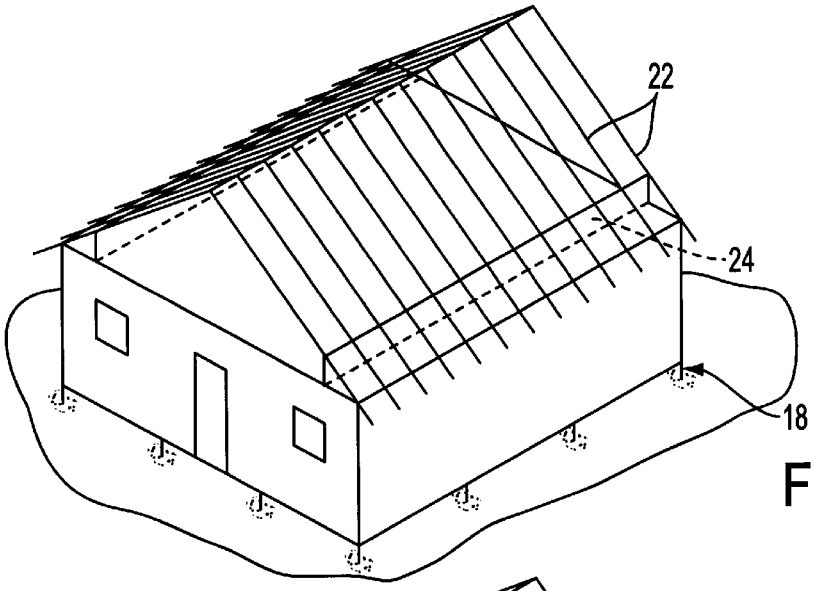

The timber framed internal partition walls are erected and fixed into position. The two ends of the container are then lifted into position on top of the walls and attached to the edge of the container's top panel to form the upper level attic floor. Ceiling floor joists are installed to the top edge of the external walls and attic floor as illustrated in FIG. 13.

Figure 15:
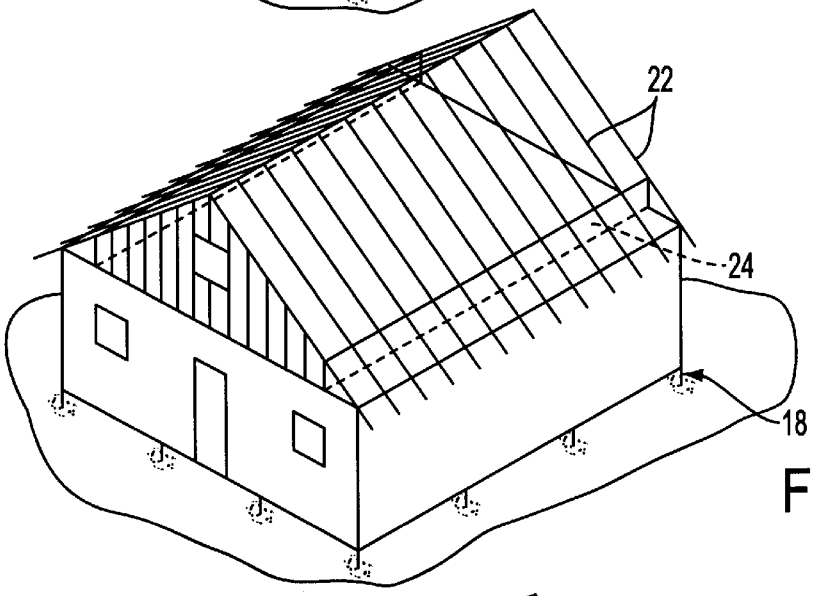
Figure 16:
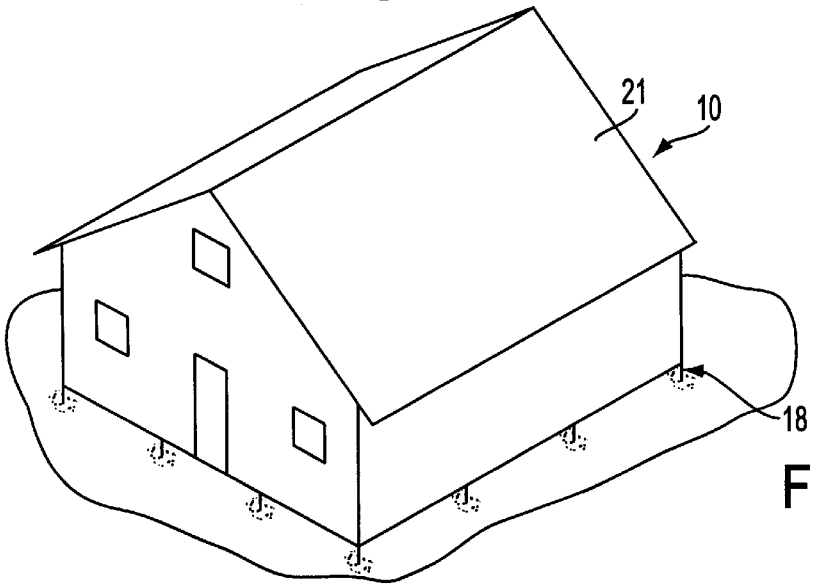

The attic walls are erected and fixed to the attic floor to form the structural box beam for the roof structure. The roof structure is then framed up from pre-cut timber components and the gable end framing is erected with the pre cut fascias and barges being installed and timber bird boards being fitted between the rafters as illustrated in FIG. 15.

The roof sheeting is installed together with all ridge cappings and flashings. Windows are installed in prepared openings and all tie down connections are fixed off. Internal lining is fitted to the timber framed partition walls, electrical outlets are fitted and internal trim is completed. All plumbing, drainage and electrical services are connected to the site supply. Finally, painting is completed if desired and both internal and external and floor coverings are installed if desired. The home is completed, ready for occupation.

Figure 17:
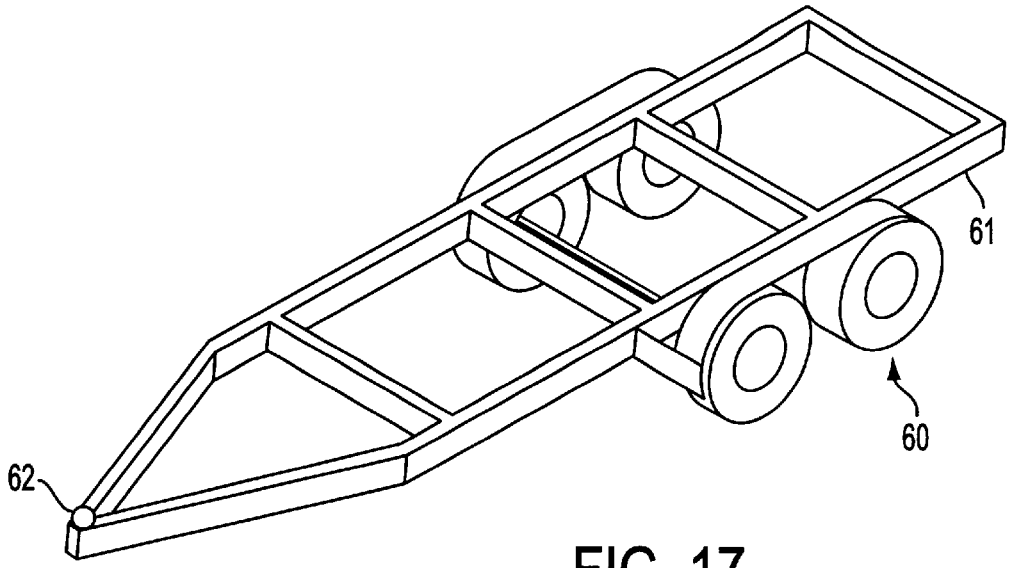
FIG. 17 is top perspective view of a trailer for use in transporting the modular structure.

Accordingly, the transportable structure according to the present invention provides an innovative transportable package designed to facilitate transporting and assembly of the structure. The structure is cost efficient as the structure design minimises packaging and simplifies the assembly process as compared to traditional modular home kits. Moreover, by the structure in its disassembled condition being dimensioned to form a container meeting ISO specifications, transporting of the structure is greatly simplified. With this system, the structure can be easily transported in its disassembled condition by ship, rolling stock, or by other vehicle. Further flexibility in the transportation of the structure is provided with the use of a trailer as depicted in FIG. 17. This purpose built trailer 60 incorporates a chassis 61 adapted to accommodate the container 50. The trailer is arranged to be connected to a conventional large vehicle through standard coupling 62. Typically the container 50 is bolted to the trailer 60 for transport. Because of the speed of erection of the structure 10 and the additional ease of transportation provided by the trailer, the system is suitable for use as a mobile home or temporary structure.

Figure 18:
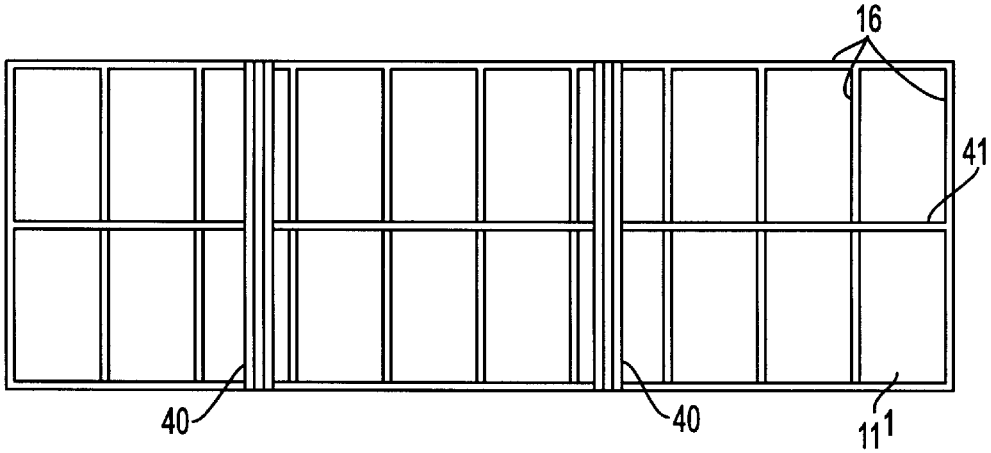
FIG. 18 is a bottom plan view of the floor section of the container.
Figure 19:
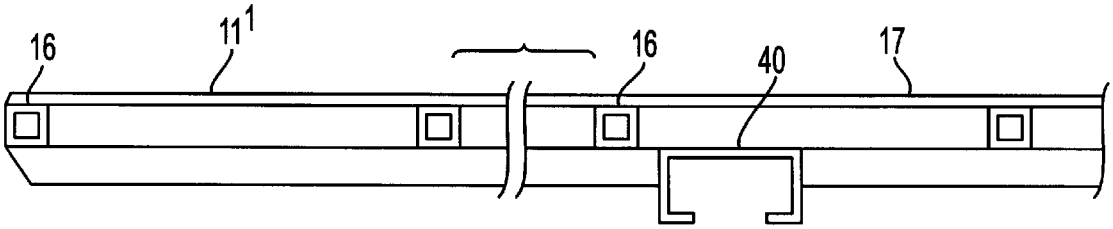
FIG. 19 is a side detail view of FIG. 18 showing optional forklift rail and support spine.

As best shown in FIGS. 18 and 19, to provide for improved ease of transport of the container, forklift carrying rails 40 can be welded to the bottom of the container's floor 11 (sheathed in sheet material 17, such as plywood) which can be further supported with an additional floor spine 41 running perpendicular to the steel framing 16. Standard container corner fittings 52 can be attached to the container to lift it sufficiently off of the ground level to clear the forklift carrying rails 40.

Finally, it must be understood that various alterations, modifications and/or additions may be introduced into the construction arrangement of the parts previously described without departing from the spirit or ambit of the invention.

We claim:

1. A transportable structure kit for use in assembling a housing structure, comprising:

exterior container panel wall sections attached together to form a completely enclosed transportable container in a transportation mode, said exterior container panel wall sections comprise a planar floor section, planar side walls, planar end walls, and a planar ceiling section, and wherein the exterior container panel wall sections are secured to form the completely enclosed transportable container in the transportation mode, and wherein in a housing structure, mode the planar floor section and at least the two planar side walls are adapted to be attached together to form a floor of the housing structure;

said exterior container panel wall sections in the transportation mode attach to one another with a plurality of bolts such that prior to assembly of the housing structure, said plurality of attachment bolts are adapted to be removed so that the planar side walls may be removed from the transportable structure kit and placed on respective opposite sides of said planar floor section to form at least a portion of the floor in the housing structure;

a plurality of interior panel sections adapted to be placed within the completely enclosed transportable container; and means on corners of the enclosed transportable container adapted to allow the container to be hoisted and moved, wherein the exterior container panel wall sections and interior panel sections are adapted to be assembled into a housing structure in a housing structure mode.

2. The transportable structure kit of claim 1, wherein in the housing structure mode said housing structure floor comprises a first and a second story floor and the exterior panel wall sections other than the ones used in assembly of the first floor are used for assembly of the second story floor of the assembled housing structure.

3. The transportable structure kit of claim 1, wherein at least two spaced apart interior wall panel sections span and are permanently attached to the planar ceiling section and the planar floor section.

4. The transportable structure kit of claim 3, wherein a pre-assembled bathroom is located within the at least two spaced apart interior wall panel sections which permanently attach to the planar ceiling section and the planar floor section.

5. The transportable structure kit of claim 1, further comprising additional pre-manufactured components of the kit including external wall sandwich panels, internal partition walls, doors, windows, roof framing, gable framing, facias, barges, finishing materials, and hardware.

6. The transportable structure kit of claim 1, further comprising telescoping footing sections to permanently yet adjustably adjust the height of the floor relative to a foundation upon which the assembled structure is adapted to be supported, the telescoping footing sections having a lower portion being adapted to be permanently affixed to the foundation.

7. The transportable structure kit of claim 1, wherein the exterior container panel wall sections comprise a steel framework sheathed on at least one side with sheathing material.

8. The transportable structure kit of claim 1, wherein the means on corners of the completely enclosed transportable container adapted to allow the container to be lifted and moved comprise metal lugs adapted to be detachably attacbed to the corners.

9. The transportable structure kit of claim 1, further comprising rail members affixed to a bottom surface of the planar floor section to allow for forklift carrying of the container.

10. The transportable structure kit of claim 1, wherein the planar floor section, planar side walls, planar end walls, and a planar ceiling section comprise unitary sections.

11. A transportable structure kit for use in assembling a housing structure, comprising:

unitary exterior container panel wall sections attached together to form a completely enclosed transportable container in a transportation mode, the unitary exterior container panel wall sections comprising a planar floor section, planar side walls, planar end walls, and a planar ceiling section, and the exterior container panel wall sections being adapted to be detachably attached together to form the completely enclosed transportable container in a transportation mode, and wherein the planar floor section and at least the two planar side walls are adapted to be attached together to form a floor of the housing structure in a housing structure mode, and wherein in the housing structure mode, the planar floor section and at least the two planar side walls are attached together to form a floor of the housing structure;

said exterior container panel wall sections in the transportation mode attach to one another with a plurality of bolts such that prior to assembly of the housing structure, said plurality of attachment bolts are adapted to be removed so that the planar side walls may be removed from the transportable structure kit and placed on respective opposite sides of said planar floor section to form at least a portion of the floor in the housing structure;

a plurality of interior panel sections and other components necessary to form the housing structure placed within the completely enclosed transportable container, the interior panel sections and other used in assembling the housing structure; and means on corners of the enclosed transportable container adapted to allow the transportable container to be hoisted and moved.

12. The transportable structure kit of claim 11, wherein the exterior panel wall sections other than utilized in assembly of the floor are used for assembly of a second story floor of the assembled structure.

13. The transportable structure kit of claim 11, wherein at least two spaced apart interior wall panel sections span and are permanently attached to the planar ceiling section and the planar floor section.

14. The transportable structure kit of claim 11, wherein the exterior container panel wall sections comprise a steel framework sheathed on at least one side with sheathing material.

15. The transportable structure kit of claim 11, wherein the means on corners of the completely enclosed transportable container adapted to allow the container to be lifted and moved comprise metal lugs adapted to be detachably attached to the corners.

16. The transportable structure kit of claim 11, further comprising rail members affixed to a bottom surface of the planar floor section to allow for forklift carrying of the container.

* * * * *